US011407623B2

(12) United States Patent
Boggess

(10) Patent No.: US 11,407,623 B2
(45) Date of Patent: Aug. 9, 2022

(54) CONFIGURABLE LIFT SYSTEM

(71) Applicant: Bary Sanford Boggess, North Ogden, UT (US)

(72) Inventor: Bary Sanford Boggess, North Ogden, UT (US)

( * ) Notice: Subject to any disclaimer, the term of this patent is extended or adjusted under 35 U.S.C. 154(b) by 408 days.

(21) Appl. No.: 16/687,600

(22) Filed: Nov. 18, 2019

(65) Prior Publication Data

US 2020/0122988 A1 Apr. 23, 2020

Related U.S. Application Data

(60) Provisional application No. 62/748,428, filed on Oct. 20, 2018.

(51) Int. Cl.
*B66F 7/28* (2006.01)

(52) U.S. Cl.
CPC ..... *B66F 7/28* (2013.01)

(58) Field of Classification Search
CPC . A63B 63/06–067; A63B 51/00; B66F 3/242; B66F 7/00–08; B62H 3/12
USPC ..... 211/1.56, 1.57, 18, 208, 209
See application file for complete search history.

(56) References Cited

U.S. PATENT DOCUMENTS 3,907,113 A * 9/1975 Kropelnitski ..... B62H 3/12 414/227
5,183,162 A * 2/1993 Ritzenthaler ..... B62H 3/12 211/121
6,640,934 B1 * 11/2003 Edwards ..... B66B 9/00 187/254
6,676,233 B1 * 1/2004 Evans ..... B66B 9/02 187/401
6,729,478 B1 * 5/2004 Boers ..... B62H 3/12 211/18
8,191,487 B2 * 6/2012 Theesfeld ..... F16M 11/24 108/50.01
8,875,844 B2 * 11/2014 Janz ..... B66D 1/60 187/244
10,334,948 B2 * 7/2019 Xiang ..... A47B 57/06
2002/0134742 A1 * 9/2002 Huang ..... F16M 13/022 211/17
2003/0205433 A1 * 11/2003 Hagman ..... B66F 9/20 187/231
2010/0096347 A1 * 4/2010 Theobald ..... B60R 9/06 211/13.1
2012/0024802 A1 * 2/2012 Dovner ..... B62H 3/12 211/17
2012/0298605 A1 * 11/2012 Dovner ..... B62H 3/12 211/13.1
2017/0341924 A1 * 11/2017 DeWitt ..... B60P 7/0815
2019/0241414 A1 * 8/2019 Willard ..... B66D 1/12

* cited by examiner

*Primary Examiner* — Joshua T Kennedy

(57) ABSTRACT

A lift system including an extendable column mounted to a wall or free standing on which rides one or more carriages that are raised and lowered by a lifting mechanism. The carriages are removable and capable of having various attachments.

6 Claims, 5 Drawing Sheets

CONFIGURABLE LIFT SYSTEM

TECHNICAL FIELD

The disclosure relates to the field of lift systems and more particularly to a configurable minimalist lift system.

BACKGROUND

Lift systems are often used to position items such as vehicles at a height that makes it more convenient to do work on them or inspect areas that are inconvenient to access when on the ground. Lift systems are also used to raise items off the ground for storage or temporary relocation to a position above the ground to free up floor space for other uses such as vehicle parking. Lift systems are also commonly employed to ergonomically position work benches at a height to suit a user's comfortable working height. All of these forms of lift exist independently but what is lacking is a compact lift with multiple carriages that can be fitted with various accessory attachments to accommodate a variety of lifting needs where the carriages are easily removed and the mounting structure such as a wall is not stressed as a result of lifting heavy loads.

The present disclosure of a configurable lift system addresses this unfulfilled need by making it convenient to configure the lift for any of the above uses or mixing any of the above uses while maintaining a minimalistic approach that results in a versatile lift system that occupies very little space, is easy to use and is expandable to accommodate various applications. The present disclosure also adds the functionality of being able to add and remove the carriages from the lift system without disassembly of any of the components. This makes adding and removing carriages convenient but more importantly this makes it possible for any carriages to be lowered to a bottom position without interfering with other lower carriages. This capability is advantageous when loading heavy items such as motorcycles. Lifting heavy loads such as motorcycles on a support member cantilevered a distance from the track creates a moment about the base of the lift which would result in a significant tension load on a mounting structure such a wall if it were not for the structural brace of the present disclosure that resists in part or in full said moment.

SUMMARY

Embodiments of the lift system are versatile, space saving, expandable and configurable. According to an embodiment, the lift system includes a column standing vertically that sits on a support surface and is attached to a wall or other structure which can include a floor or overhead structure. Attached to the column is a lifting mechanism arranged to raise and lower one or more carriages that travel vertically along the column.

According to a variation, the column has tracks that engage rollers or sliders attached to the carriage and guide one or more carriages as they travel along the column. Additional carriages can be quickly and easily attached to or detached from the track so that more than a single carriage may be engaged on the track at a time. The ability to easily detach carriages from the tracks allows the carriages above to be lowered to the bottom position. The carriages are equipped with a receiver for attaching various different accessory attachments.

According to a variation, the lift system can include one or more accessory attachments that can be easily and selectively added to or removed from a carriage to reconfigure it for different applications. The various different attachments may include for example a platform to which a motorcycle can be secured, a bicycle rack, a work bench, kayak rack, cargo basket or others. The ability to add additional carriages and attach accessories to the carriages makes it possible for multiple attachments to be used at a time which increases the capabilities and variety of uses at a time. It also facilitates the positioning of a load in preparation for lifting in the case that the accessory attachment would interfere with the positioning of the load if it were not detachable.

According to a variation, the column and track are segmented and can have extension segments removably attached to vary a height of the system.

According to a variation the column is freestanding.

According to a variation the column has a brace that extends a distance in front of the column and contacts a support surface.

According to a variation the track rails have openings by which the rollers of the one or more carriages may enter or exit.

BRIEF DESCRIPTION OF THE DRAWINGS

These and other features, aspects, and advantages of the present disclosure will become better understood regarding the following description, appended claims and accompanying drawings.

DETAILED DESCRIPTION

It will be understood that, unless a term is expressly defined in this disclosure to possess a described meaning, there is no intent to limit the meaning of such term, either expressly or indirectly, beyond its plain or ordinary meaning.

Any element in a claim that does not explicitly state "means for" performing a specified function, or "step for" performing a specific function, is not to be interpreted as a "means" or "step" clause as specified in 35 U.S.C. § 112, paragraph 6.

The present invention, a configurable lift system, is a versatile and compact lift that can be fitted with multiple carriages allowing for multiple cargo loads to be raised off the floor in succession in an over/under or stacked arrangement.

Figure 1:
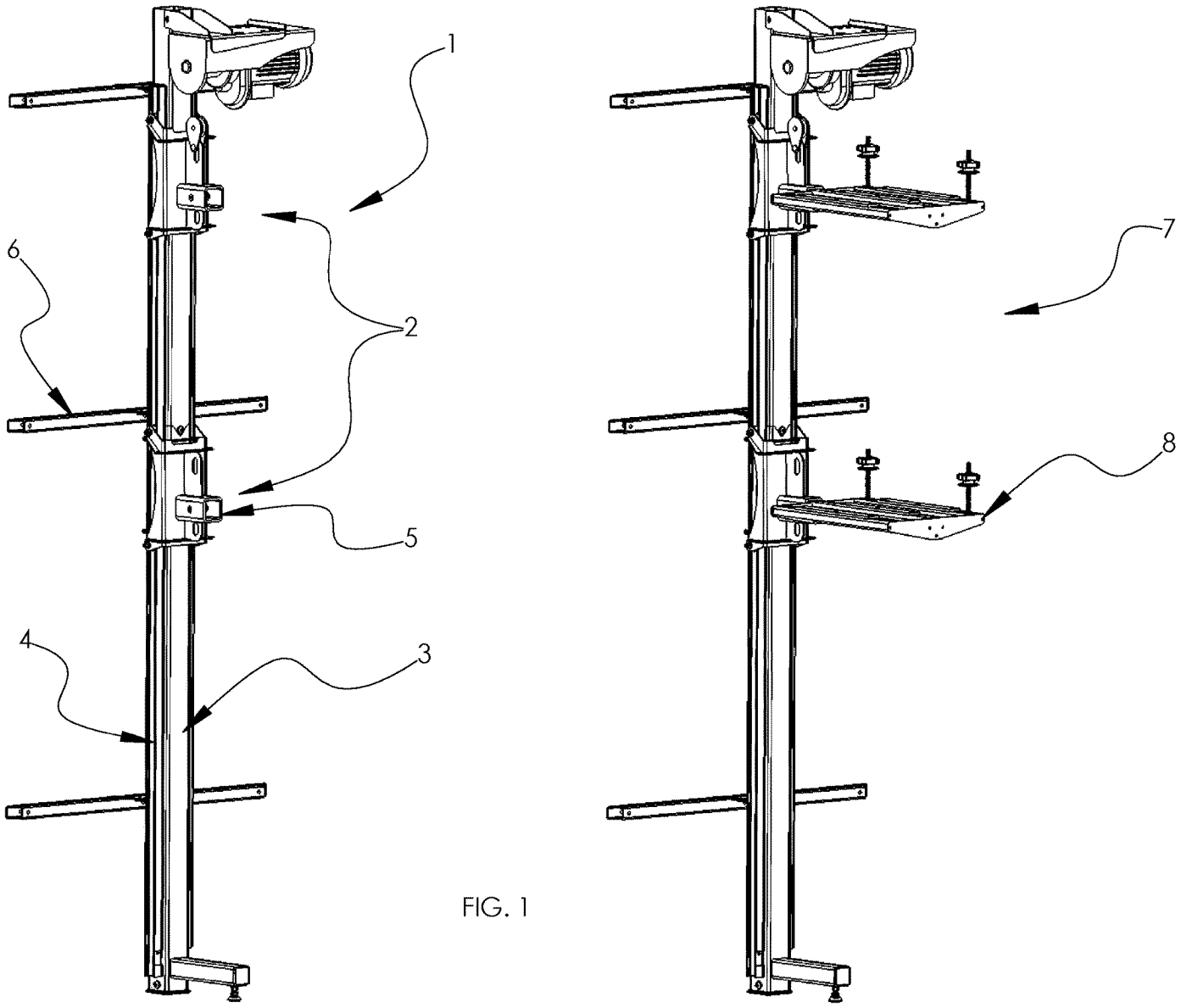
FIG. 1 shows two views of the lift system according to an embodiment. One with no attachments and the other with an attachment intended for securing and lifting motorcycles.

In FIG. 1 we see depicted the lift system 1 with carriages 2 that are guided up and down the column 3 by the tracks 4. The receiver 5 of the carriages are shown without any accessory attachment installed. The Lift system may be mounted to a wall or other supporting structure or be free standing. The embodiment of FIG. 1 is shown using wall mounting bars 6. Also depicted is the same embodiment in a different view 7 with possible accessory attachments 8 used for securing and lifting motorcycles.

Figure 2:
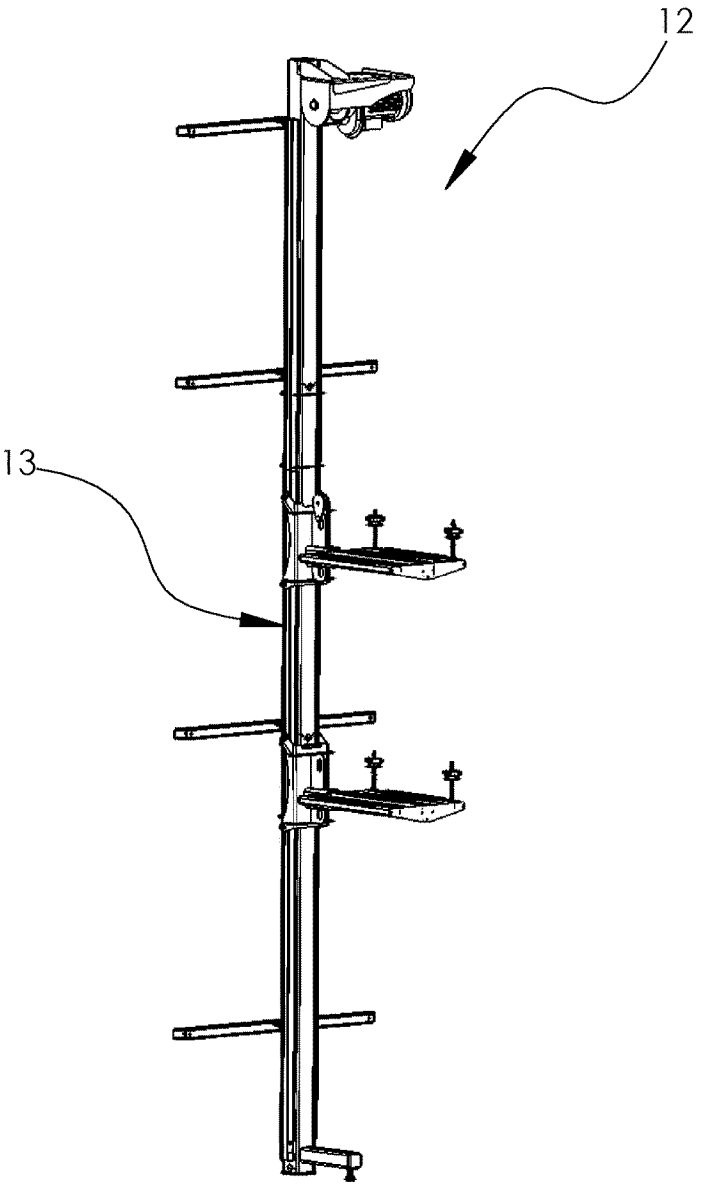
FIG. 2 shows an exploded view demonstrating how the lift system is modular and can be expanded.
Figure 2:
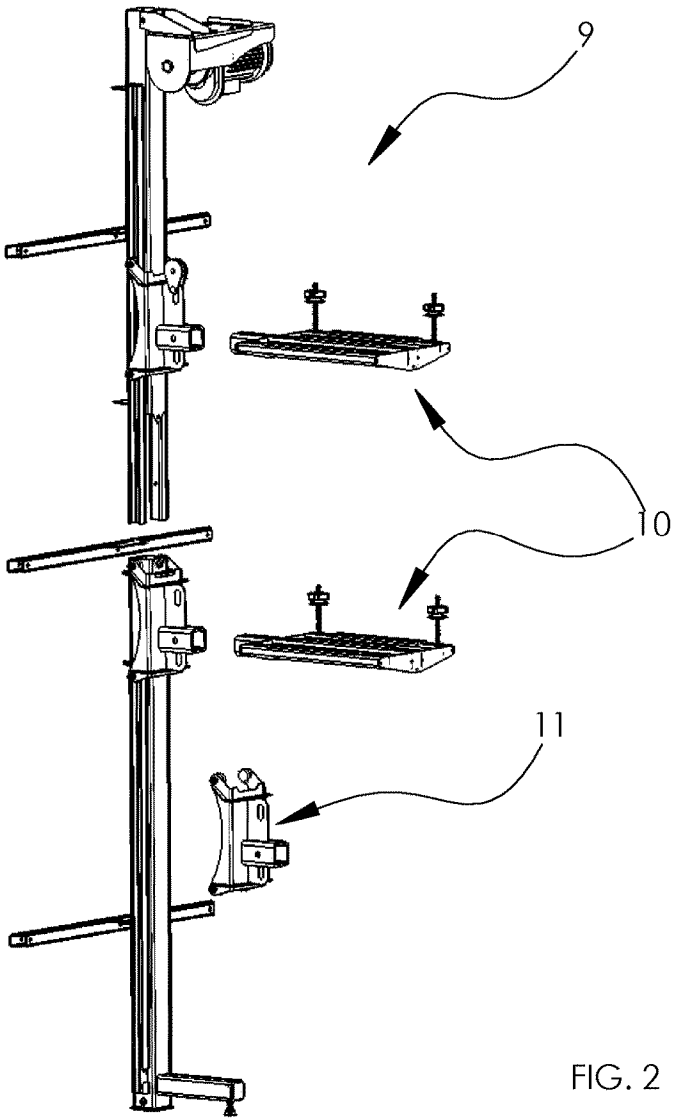

FIG. 2 shows an exploded view 9 which demonstrates how the lift system is modular and extendable. A variety of accessory attachments such as the motorcycle platforms 10 can be added or removed and replaced with other accessory attachments as desired. Also, carriages 11 can be added or removed. The assembly 12 is shown with an extension section 13 added for additional height capacity.

Figure 3:
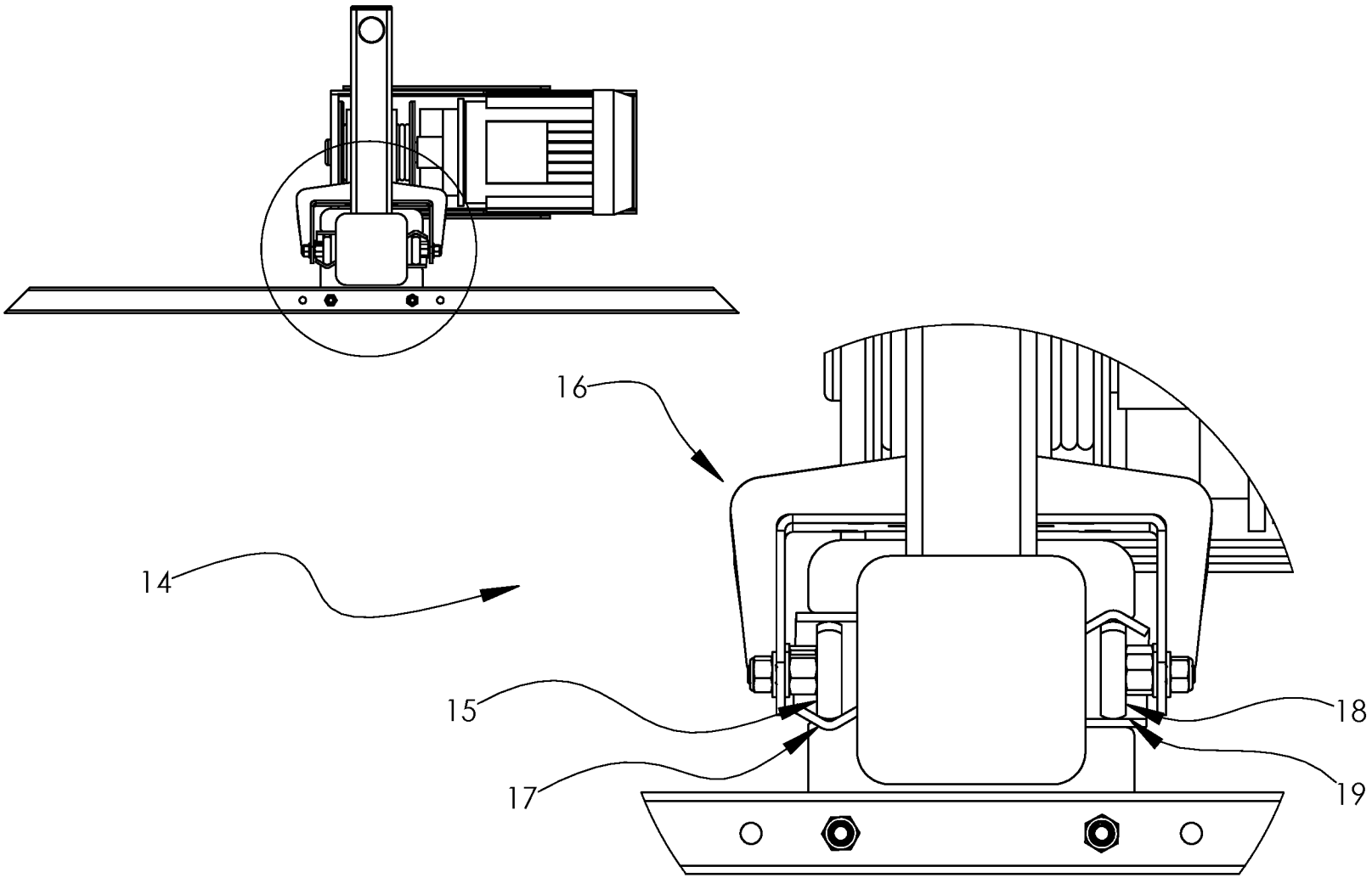
FIG. 3 shows a detail view of a possible guide track and roller design.

FIG. 3 shows a detail view 14 of a track and roller design where the roller 15 of one side of the carriage 16 is guided by the V of the track 17 while the roller 18 of the other side can vary some in width as it can float on the flat 19 of the opposite track.

Figure 4:
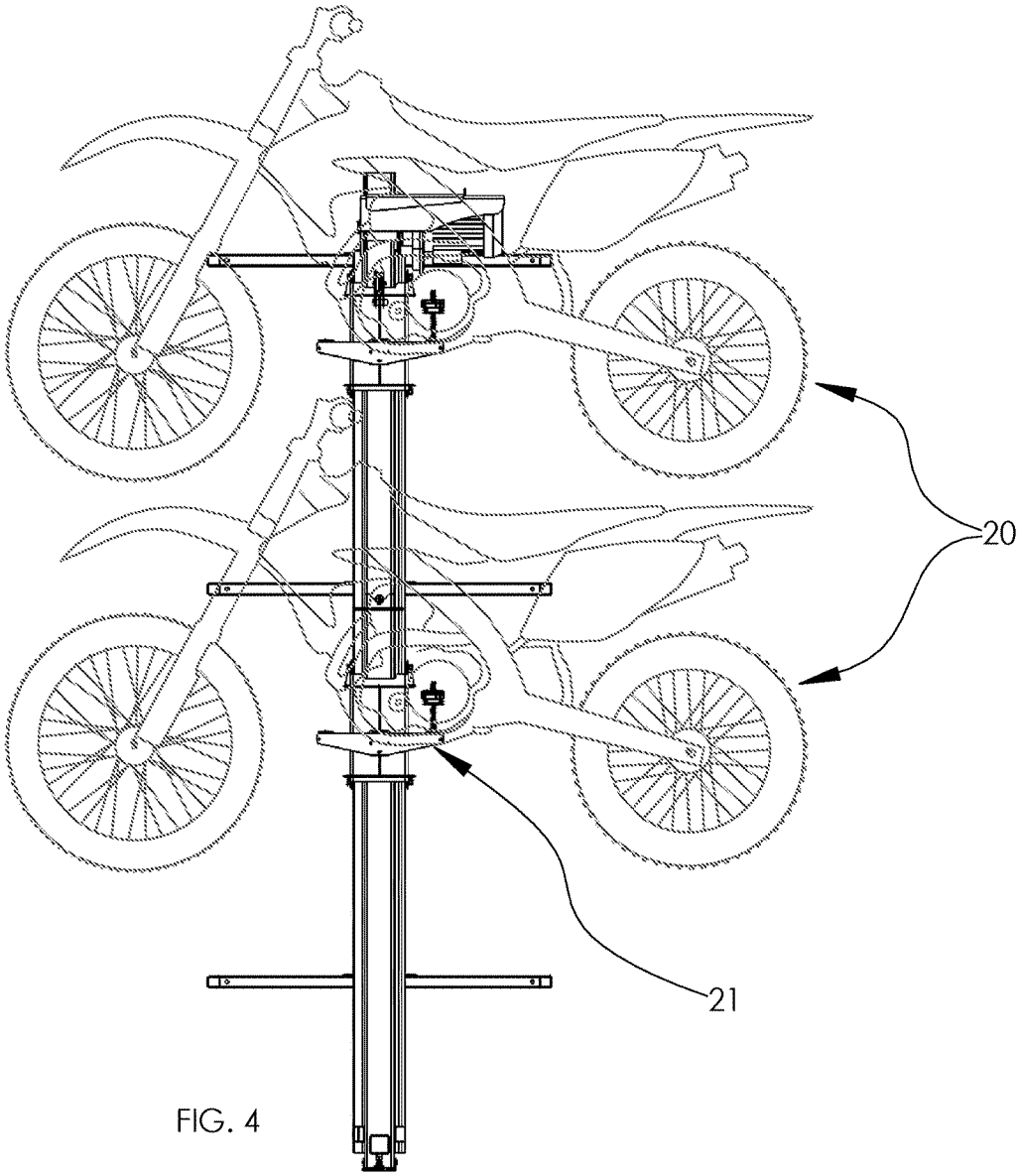
FIG. 4 demonstrates how two or more dirt bike motorcycles can be raised for storage in a stacked formation.

FIG. 4 depicts motorcycles 20 secured to the motorcycle lift accessory platforms 21 to demonstrate how carriages and their cargo are raised in a sequentially stacked formation.

Figure 5:
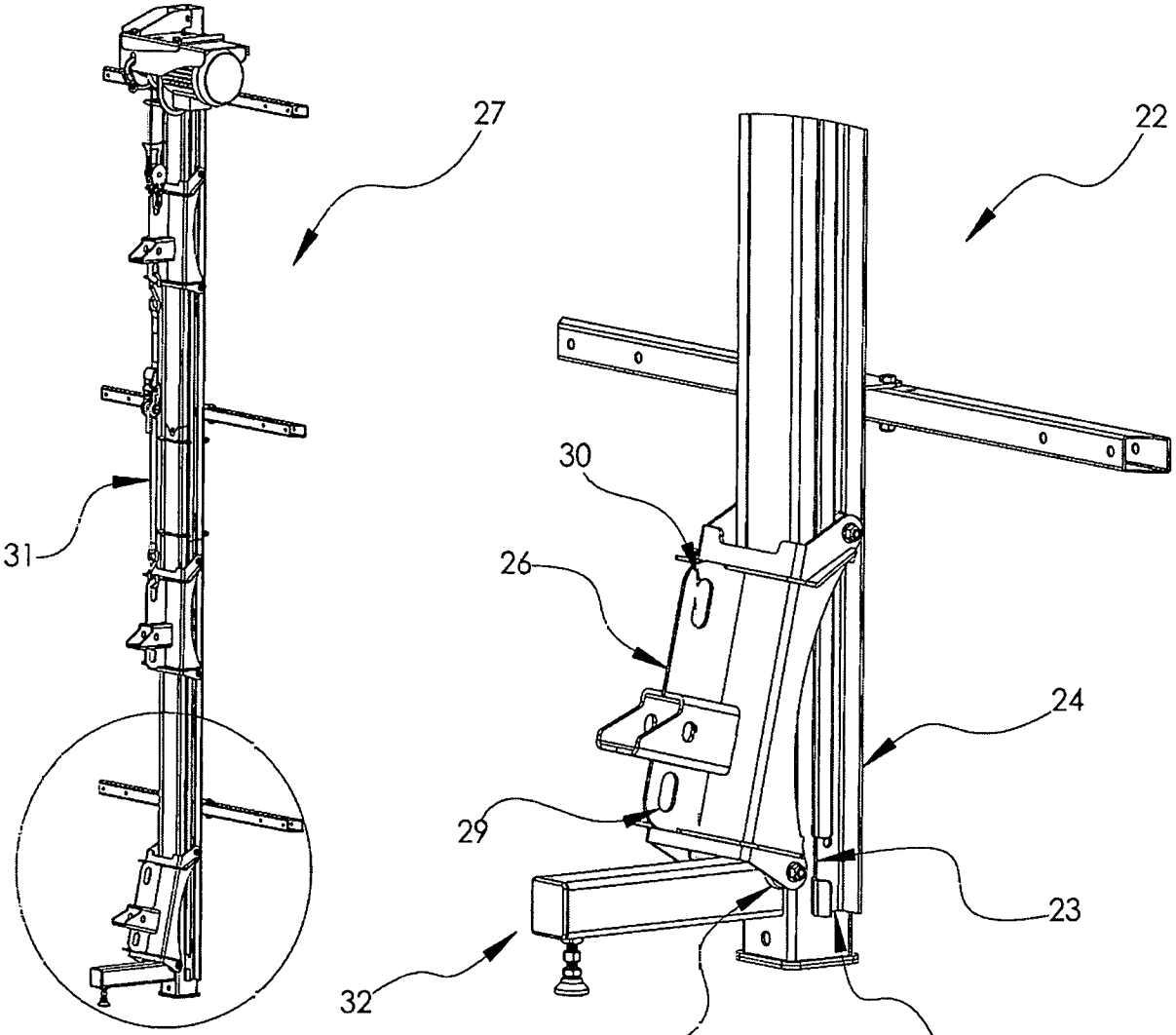
FIG. 5 demonstrates how a carriage is removable without the need for disassembly of any of the lift system's components as well as how carriages are linked together. Also shown is a brace extending in front of the column.

FIG. 5 shows a detail view 22 of an opening 23 in the track rail 24 which allows roller 25 to exit the track rail 24 for simple addition and removal of the carriage 26 from the lift system 27. An open end of a track rail 28 can also be used to allow the roller 25 to exit and enter the track rail 24 according to a variation. Coupling features 29 and 30 can be used to link multiple carriages together with a strap, chain, cable, or other device 31 which maintains a spacing between the carriages and causes them travel in unison. A brace 32 that extends a distance in front of the column and is positioned on a support surface to counter in part or in full the moment that results from a cantilevered load applied to the one or more carriages. Note that in in FIG. 5 the coupling features 29 and 30 are depicted as simple cutouts but can be any coupling feature that achieves an equivalent function (e.g. hooks, pins, ball and socket, threaded fastener etc.).

The invention claimed is:

1. A lift system comprising:

a column oriented substantially vertically;

one or more carriages, wherein each carriage of the one or more carriages comprises:

a first and a second roller on first and second sides, respectively;

one or more coupling features configured for linking multiple carriages of the one or more carriages together; and a receiver configured to attach an accessory thereto;

a track system attached to the column and having vertical rails configured to accept said first and second rollers of each of said one or more carriages to guide said one or more carriages along the track system;

wherein said vertical rails have at least one pair of cutouts being located between first and second ends of the track system and configured to correspond with said first and second rollers and thereof to allow entry and exit thereof without disassembly of the track system; and a drive unit configured to translate the one or more carriages along the track.

2. The lift system of claim 1, wherein the rails of the track system are configured such that a first rail on a first side of said track system guides said first roller while allowing said second roller to move laterally.

3. The lift system of claim 1, further comprising at least one accessory removably attached to said receiver.

4. The lift system of claim 1, wherein the column and track system are segmented such that extensions may be removably attached to adjust a height of the system.

5. The lift system of claim 1, wherein said rollers of said one or more carriages are positioned between carriage sidewalls.

6. The lift system of claim 1, further comprising at least one brace member attached to the column and configured to contact a support surface.

* * * * *